United States Patent [19]

Honkala et al.

[11] Patent Number: 5,038,678

[45] Date of Patent: Aug. 13, 1991

[54] CALENDER, IN PARTICULAR A SUPERCALENDER WITH MULTIPLE RELIEF DEVICES

[75] Inventors: Juha Honkala, Helsinki; Wilhelm Landin, Ohkola; Timo Hirvonen, Hyvinkää; Seppo Pukkinen, Riihimäki; Ari Lassila, Espoo, all of Finland

[73] Assignee: Valmet Paper Machinery Inc., Finland

[21] Appl. No.: 457,278

[22] Filed: Dec. 27, 1989

[30] Foreign Application Priority Data

Jan. 27, 1989 [FI] Finland ..... 890403

[51] Int. Cl.[5] ..... B30B 3/04

[52] U.S. Cl. ..... 100/170; 100/169; 100/168; 100/47; 100/163 R; 100/163 A

[58] Field of Search ..... 100/170, 169, 168, 47, 100/163 R, 163 A

[56] References Cited

U.S. PATENT DOCUMENTS

| | | | |
|---|---|---|---|
| 3,554,118 | 1/1971 | Laine | 100/170 |
| 4,721,039 | 1/1988 | Lehmann | 100/162 B |
| 4,890,551 | 1/1990 | Dahl | 100/170 |
| 4,924,772 | 1/1990 | Schlunke | 100/170 |

*Primary Examiner*—Paul T. Sewell

*Assistant Examiner*—Thomas P. Hilliard

*Attorney, Agent, or Firm*—Steinberg & Raskin

[57] ABSTRACT

The invention concerns a calender, in particular a supercalender, on whose frame (1) a set of rolls (2) is mounted, which comprises an upper roll (3), a lower roll (4), and several intermediate rolls (5) placed between the upper roll and the lower roll. The rolls (3, 4, 5) are supported on the frame (1) by the intermediate structure of the base parts (34, 47, 54) being vertically displaceable along guides (7) provided in the frame. Of the base parts, at least the base parts (54) of the intermediate rolls can be positioned in the vertical direction by means of lifting spindles (6) provided in the frame (1) and by means of spindle nuts (56) provided on the spindle. The base parts (54) of the intermediate rolls are supported on the lifting spindles (6) being vertically displaceable by means of pressure-medium operated relief devices (57) arranged between the base parts (54) and the spindle nuts (56) to reduce the journal loads on the rolls (5). The bearing housings (51) of the intermediate rolls are attached to the base parts (54) being pivotable relative to an articulation shaft (53) parallel to the axes of the rolls (3, 4, 5) and supported on the base parts (54) by means of attenuation devices (10) to equalize the forces resulting from movements of the nips ($N_1$, $N_2$, $N_3$, $N_4$) between the rolls and to attenuate oscillations of the rolls (5).

10 Claims, 5 Drawing Sheets

CALENDER, IN PARTICULAR A SUPERCALENDER WITH MULTIPLE RELIEF DEVICES

BACKGROUND OF THE INVENTION

The invention concerns a calender, in particular a supercalender, on whose frame a set of rolls is mounted, which is shaped as a stick of rolls placed one above the other and which comprises an upper roll, a lower roll and several intermediate rolls placed between the upper roll and the lower roll, the rolls being supported on the frame by the intermediate of the base parts as vertically displaceable along guides provided in the frame, of which at least the base parts of the intermediate rolls can be positioned in the vertical direction by means of lifting spindles provided in the frame and by means of spindle nuts provided on the spindle.

The system of rolls in a conventional supercalender comprises a number of rolls, which are arranged one above the other as a stack of rolls. The rolls placed one above the other are in nip contact with each other, and the paper web to be calendered is arranged to run through the nips between the rolls. The rolls in the system of rolls are normally mounted rotatably in bearing housings, which are again attached to base parts that are fitted to glide on vertical guides provided in the frame of the calender. Moreover, the base parts are provided with stop parts, which are fitted on vertical lifting spindles provided in the frame of the calender. Thus, one of the functions of the lifting spindles is to act as guides so as to keep the rolls in the system of rolls in the correct position. Thus, the bearing housings of the rolls in the system of rolls are not fixed rigidly to the calender frame, but the bearing housings, and consequently also the rolls, can move vertically. Since the masses of the bearing housings of the rolls and the auxiliary devices attached to the housings are quite large, in conventional supercalenders this causes the considerable drawback that these masses of the bearing housings and of the auxiliary devices attached to the bearing housings cause distortions in the distributions of the linear loads in the nips Thus, the linear load in the nips is not uniform, but it is substantially higher at the ends of the nips than at the middle. Since in the systems of rolls of supercalenders there are several rolls placed one above the other, as was already stated above, this further results in the linear loads in individual nips being cumulated and causes a considerably large error in the overall linear load. This defective distribution of the linear load deteriorates the quality of the calendered paper.

With a view to solving the problem described above, in the Applicant's earlier FI patent application No. 880137 it is suggested that the system of rolls be provided with lightening devices, which are supported on the base parts of the rolls, on one hand, and on the spindle nuts provided on the lifting spindles, on the other hand, so that by means of these lightening devices, the distortions caused by the weight of the bearing housings and of auxiliary devices attached to the housings, e.g. takeoff rolls, in the lateral areas of the profiles of linear loads between the rolls can be eliminated. Also, for conventional machine calenders, a solution is known in the prior art wherein the rolls of the machine calender are provided with a lightening system, in particular with hydraulic lightening cylinders for elimination of concentrated loads arising from the bearing housings of the rolls and from auxiliary devices. It is a simple matter to provide machine calenders with such relief devices, because the rolls in the system of rolls of a machine calender are mounted on the frame of the calender by the intermediate use of levers with articulated joints. It is, however, quite difficult to use devices corresponding to the machine calenders in supercalenders because of the constantly varying diameters of the fiber rolls and because of the large number of rolls in supercalenders.

Owing to their construction, which was described above, conventional supercalenders also have a further drawback, which is concerned with the vertical movement of the rolls in the system of rolls. As was already explained above, the bearing housings of the rolls in the system of rolls are mounted on base parts, which is vertically mobile along glides provided in the frame of the calender. This further drawback is related to the friction at the guides, which is effective between said guides and the base parts. Under these circumstances, owing to the friction at the guides, the rolls in the system of rolls cannot move or be positioned in the vertical direction completely freely, which may cause disturbances in the operation of the calender as well as considerable local errors in the distributions of the linear loads. With a view to eliminating the frictions at the guides, in supercalenders it would be possible to think of using the solution described above, commonly known from machine calenders, wherein the rolls are mounted on the calender frame by the intermediate use of lever systems provided with articulated joints. The use of such an arrangement in supercalenders is, however, limited by the fact that the system of rolls in a supercalender includes several fiber rolls, whose diameter may vary to a considerable extent. Thereby, owing to the variations in the diameters of the rolls, the rolls must be able to move vertically to a considerable extent. If the rolls were mounted to the frame of the calender by the intermediate structure of lever systems with articulated joints, in such a case a vertical shifting of the rolls would also cause a considerable shifting in the transverse direction.

SUMMARY OF THE INVENTION

An object of the present invention is to provide a solution by means of which the above drawbacks found in the prior art are avoided, especially in connection with supercalenders. A more specific object of the invention is to provide a solution by whose means friction at the guides can be eliminated and by whose means the journal loads arising from the bearing housings and from auxiliary equipment in the system or rolls can be relieved so as to align the distribution of the linear loads. With a view to achieving this, and other objects of the invention which will become apparent hereinafter the invention is mainly characterized in that the base parts of the intermediate rolls are supported on the lifting spindles as vertically displaceable by means of pressure-medium operated relief devices arranged between the base parts and the spindle nuts to reduce the journal loads on the rolls and that the bearing housings of the intermediate rolls are attached to the base parts as pivotable relative to an articulation shaft parallel to the axes of the rolls and supported on the base parts and/or on the calender frame by means of attenuation devices so as to equalize the forces resulting from movements of the nips between the rolls and to attenuate oscillation of the rolls.

Of the advantages of the invention as compared with the prior art solutions, among other things, the following should be stated. By means of the solution of the invention, the profiles of linear loads in the nips in the system of rolls can be made even, owing to which the quality of the calendered paper becomes better and more uniform across the entire width of the paper web. Moreover, by means of the solution in accordance with the invention, disturbances resulting from friction at the guides for the operation of the calender can be eliminated. Further, by means of the solution in accordance with the invention, the tendency of detrimental oscillations to occur in the rolls in the system of rolls can be reduced.

DESCRIPTION OF THE PREFERRED EMBODIMENTS

Figure 1:
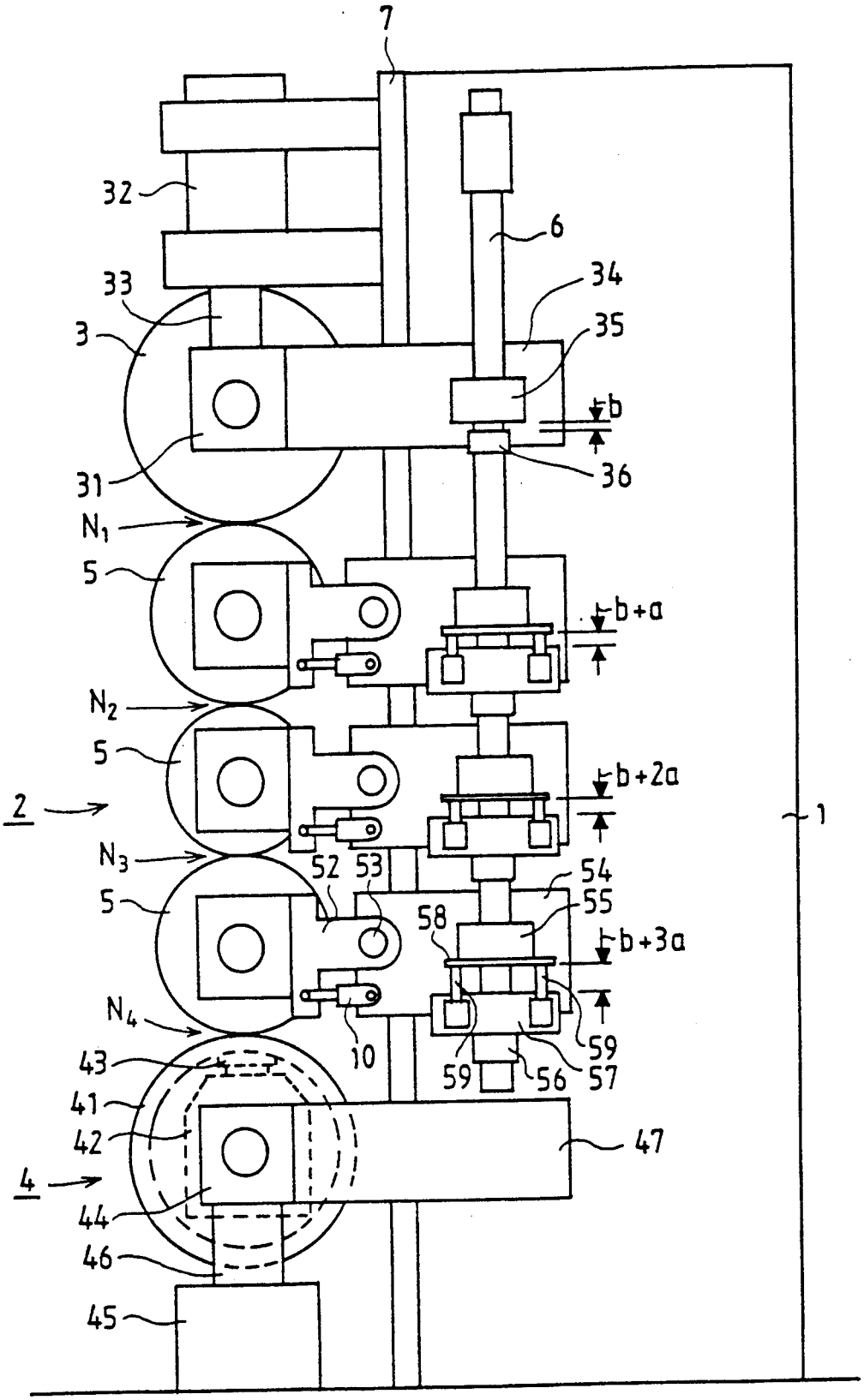
FIG. 1 is a schematical side view of a calender provided with an apparatus in accordance with the invention, with the system of rolls closed.
Figure 2:
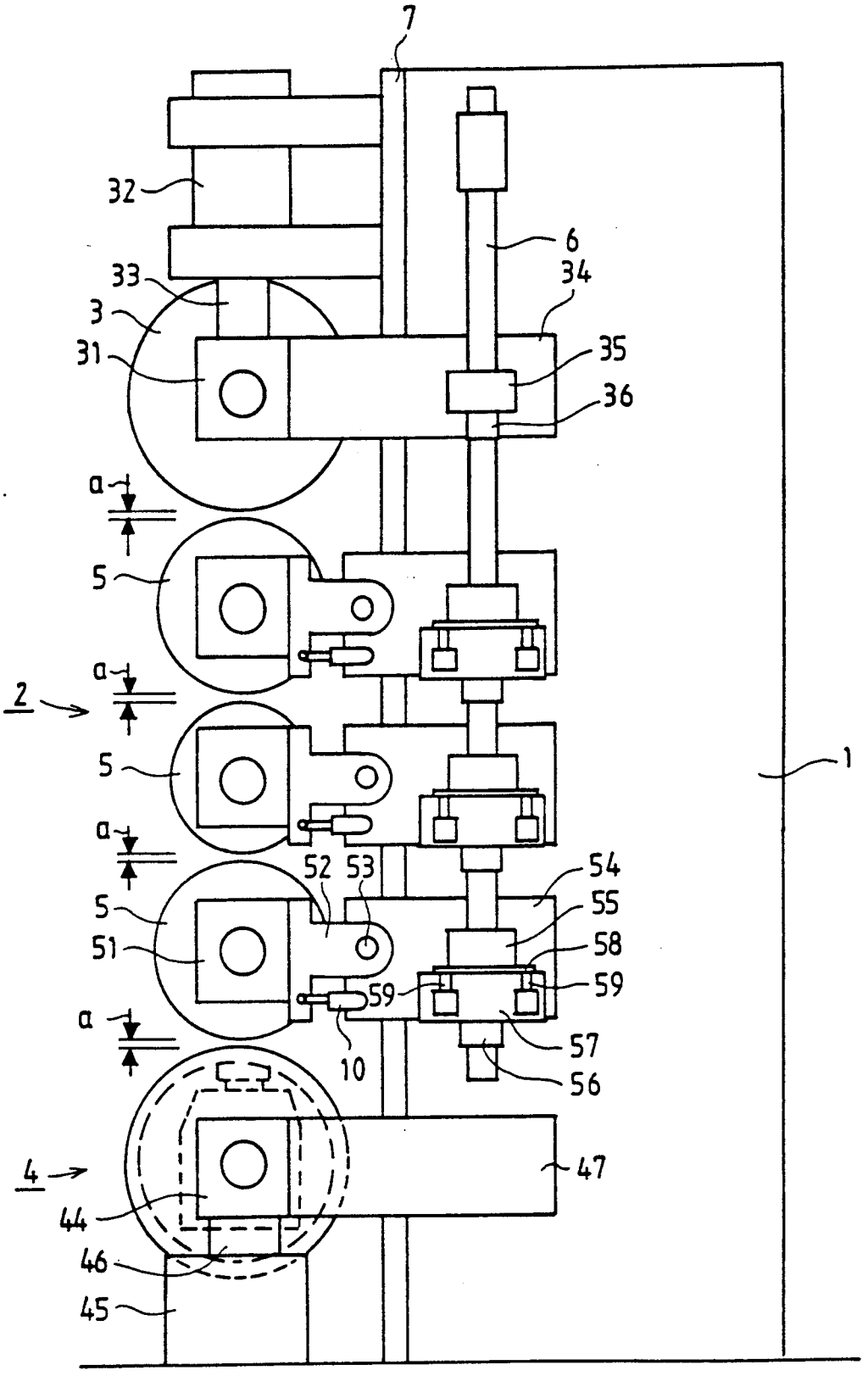
FIG. 2 shows a calender as shown in FIG. 1, with the system of rolls opened.

FIGS. 1 and 2 are schematical illustrations of a supercalender, whose frame is denoted with the reference numeral 1 and the system of rolls with the reference numeral 2. To further clarify the illustration, in FIGS. 1 and 2, the auxiliary devices included in the calender, such as takeoff rolls and their equivalent, have been omitted. As is shown in FIGS. 1 and 2, the system or rolls 2 in the supercalender comprises an upper roll 3, a lower roll 4, as well as a number of intermediate rolls 5 arranged one above the other between the upper roll and the lower roll, these rolls being arranged in such a way that they are in nip contact with one another. In the usual way, the upper roll 3 is provided with an upper cylinder 32 placed at each end of the roll and attached to the frame 1 of the calender, the piston 33 of said upper cylinder 32 acting upon the bearing housing 31 of the upper roll so as to load the system or rolls 2 to reach the desired level of linear load. In the usual way, the lower roll 4 is also provided with a lower cylinder 45 placed at each end of the roll, the piston 46 of said lower cylinder 45 acting upon the bearing housing 44 of the lower roll. By means of the lower cylinders 45, the system of rolls 2 can be opened in the usual way. In FIGS. 1 and 2 it is shown that the lower roll 4 is a variable-crown roll, which comprises a revolving roll mantle 41, which is supported in the nip plane on a non-revolving roll axle 42 by means of hydraulic loading members 43 The lower roll 4 is a so-called floating roll, whose roll mantle 41 can move in the direction of the nip plane in relation to the roll axle 42. The intermediate rolls 5 in the system of rolls 2, of which only the lowest intermediate roll is provided with detailed reference numerals in FIGS. 1 and 2, are at both of their ends mounted rotatably in bearing housings 51.

In the normal way, the calender frame 1 is provided with guides 7 as well as, at each side of the calender frame, with lifting spindles 6. The drive gear of the lifting spindle 6, which is placed in the top portion of the frame 1 in the customary way and by means of which the lifting spindle 6 is rotated and displaced in the vertical direction, is not shown in the figures in the drawing. Thus, when the lifting spindle 6 is rotated by means of the drive gear, at the same time it moves a certain distance upwards or downwards. The bearing housing 31 of the upper roll 3 is attached to the base part 34 of the upper roll, which is arranged to be displaceable along the guide 7 in the vertical direction. The base part 34 is provided with a stop part 35, through which the lifting spindle 6 extends and which stop part 35 moves on the spindle 6 in a longitudinal direction. On the lifting spindle 6, below the stop part 35, a spindle nut 36 is fitted, which is, in the situation shown in FIG. 1, when the system of rolls 2 is closed, placed at a distance of the gap b from the stop part 35.

On the contrary, the bearing housings 51 of the intermediate rolls 5 are attached to the base parts 54 of the intermediate rolls pivotally by the intermediate of lever parts 52 and articulation shafts 53. These base parts 54 of the intermediate rolls 5 are also arranged on the frame 1 of the calender as vertically displaceable along the guides 7. In a way corresponding to the base part 34 of the upper roll 3, the base parts 54 are provided with stop parts 55, through which the lifting spindle 6 extends. Underneath the stop parts 55, at a distance from them, spindle nuts 56 are fitted on the spindle 6. Each spindle nut 36, 56 is advantageously provided with an adjustable friction member, by means of which adequate friction is provided between the spindle nuts 36, 56 and the lifting spindle 6. Moreover, each spindle nut 36, 56 is provided with a locking device (not shown), by whose means, when necessary, the corresponding spindle nut 36, 56 can be locked in its position. When the spindle nut 36, 56 is not locked by means of the locking device, the spindle nut revolves, when the lifting spindle 6 is rotated, by the effect of the friction member of the spindle nut 36, 56, along with the lifting spindle 6. On the contrary, when locked, the spindle nut 36, 56 remains in its position when the lifting spindle 6 revolves. The locking device (not shown) may be, e.g., a dual-action pneumatic cylinder, by means of which the corresponding spindle nut 36, 56 can be locked as non-revolving when necessary. Between the stop parts 55 provided in the base parts 54 of the intermediate rolls 5 and the spindle nuts 56, a pressure-medium operated relief device 57 is provided, whose construction is also shown in more detail in FIGS. 3 to 6.

The relief device comprises a body 57, which is arranged to be mounted on the spindle nut 56. Above the body 57, a plate 58 is fitted, which reaches contact with the lower face of the stop part 55. The body 57 of the relief device is provided with pressure-medium operated power units 59, the plate 58 being raised apart from the body 57 by feeding a pressure medium into the power units 59. The power units 59 comprise cylindrical bores formed into the body 57 of the relief device, into which bores pistons have been fitted which are directed upwards and which rest against the lower face of the plate 58 placed above the body 57 of the relief device.

In FIG. 1 a situation is shown wherein the system of rolls 2 of the calender is closed, i.e. the nips $N_1 \ldots N_4$ are closed, and correspondingly FIG. 2 shows a situation wherein the nips $N_1 \ldots N_4$ are opened, e.g., for replacement of a roll, in which case there are gaps a, c between the rolls 3,4,5 in the system of rolls. When the system of rolls 2 is closed, there is a gap b between the stop part 35 of the upper roll 3 and the spindle nut 36, this gap being closed in accordance with FIG. 2 when the system of rolls 2 is opened. When the system of rolls is in the closed position, the power units 59 are in operation, i.e. a hydraulic/pneumatic pressure medium has been fed into them so that the pistons of the power units 59 push the plates 58 upwards and against the stop parts 55.

Figure 3:
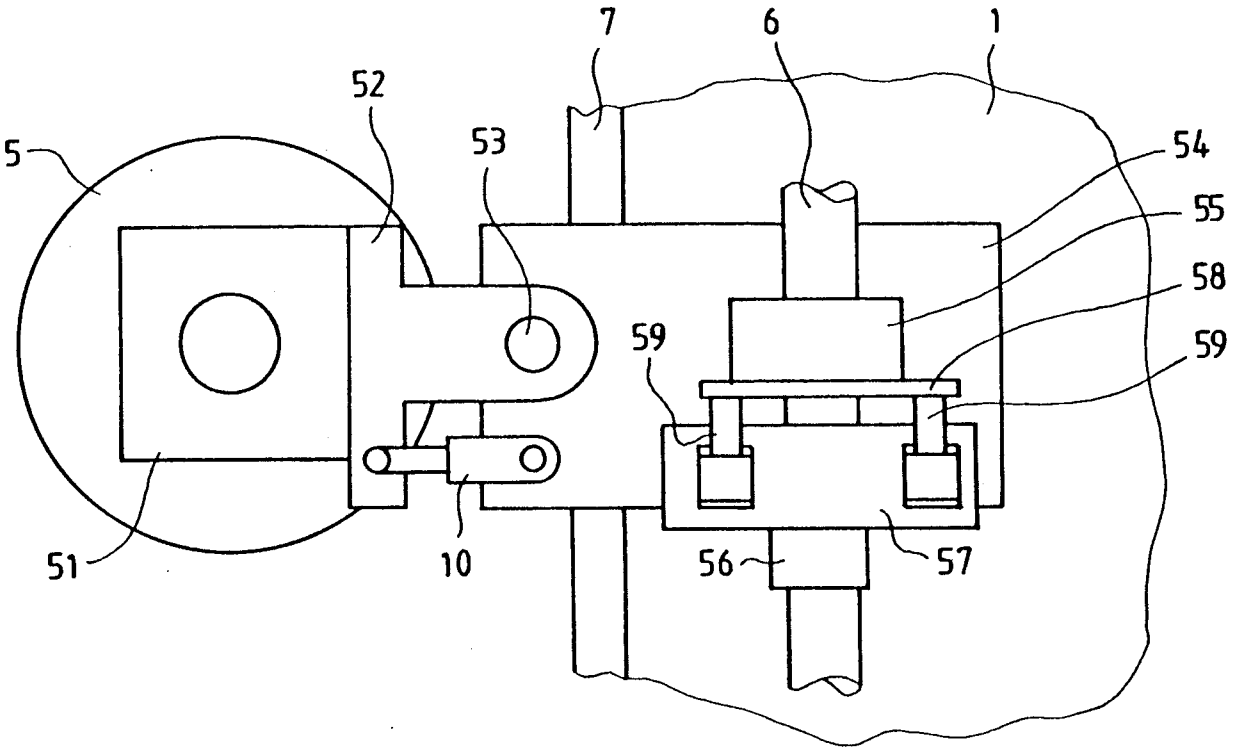
FIG. 3 is an enlarged view of a detail of FIG. 1.

In order that an equally large gap a could be obtained between the upper roll 3 and the uppermost intermediate roll 5 and, on the other hand, between the other intermediate rolls when the system of rolls 2 is in the opened position, the stroke lengths of the pistons in the power units 59 have been chosen so that, as is shown in FIG. 1, the stroke length in the power units 59 of the uppermost intermediate roll 5 has a magnitude of b+a, and in the subsequent intermediate rolls 5 the stroke length is always by the dimension a larger as compared with the preceding intermediate roll 5. This comes from the circumstance that instantaneous opening of the system of rolls 2 is carried out exactly by means of the power units 59 discharging the pressure out of the power unit and by means of the lower cylinder 45, lowering the lower roll 4 while the base part 47 of the lower roll glides down along the guide 7. Since the bearing housings 51 of the intermediate rolls 5 are attached to the base parts 54 by means of the lever parts 52 and the pivot shafts 53 with articulated joints, attenuation devices 10 are provided between said lever parts 52 and the base parts 54, said attenuation devices 10 supporting the lever parts 52 in relation to the base parts 54 during running. A first embodiment of the attenuation devices 10 is illustrated in FIGS. 1 to 3, and their operation and significance for the invention will be described in more detail later.

In this connection it should, however, be ascertained that, when the system of rolls 2 is opened, the pressure is discharged out of the attenuation devices 10 of the type of a cylinder-piston device. Thereby, when the system of rolls 2 is opened, the base parts 54 of the intermediate rolls 5 rest completely on the spindle nuts, and the lever parts 52 are pivoted down around the articulation shaft 53 so that the bottom edge of the lever part 52 reaches contact with the base part 54, which, thus, operates as a limiter of the pivoting of the lever part 52. In the figures in the drawing, the gap between the bottom edge of the lever part 52 and the base part 54 has been exaggerated. From the opened position the system of rolls 2 is closed so that first the system of rolls 2 is run into the closed position by means of the lower cylinder 45, whereupon the attenuation devices 10 and the power units 59 are pressurized.

For the purpose of regulation of the system of rolls 2, it is necessary to make the spindle nuts 56 free in order that the lifting spindle 6 could be rotated. In a calender in accordance with FIGS. 1 and 2 this is accomplished so that the pressure is released out of the upper cylinder 32 and out of the power units 59, whereupon the bearing housings 44 of the lower cylinder and the whole roll 4 are raised by means of the lower cylinders 45. It is also possible that the roll mantle 41 is raised in relation to the axle 42 by means of the loading members 43 of the lower roll 4. The attenuation devices 10, which are of the cylinder-piston type in the embodiment of FIG. 1, are not affected in this state, but they are kept under pressure. Thereby the intermediate rolls 5 rise one at a time so that first the lever parts 52 pivot around the articulation shafts 53 upwards until the upper edges of the lever parts 52 reach contact with the base parts 54, whereby the base parts 54 rise along with the rolls 5. The relief devices 57 are provided with members which prevent falling down of the body parts 57 of the relief devices when the power units 59 are free of pressure. Thus, these body parts 57 rise along with the base parts 54 off the top of the spindle nuts 56, whereby it is possible to adjust the lifting spindle 6.

After the regulation has been completed and when the whole system of rolls 2 is together, pressures are admitted into the power units 59, and the mantle 41 of the lower roll is lowered somewhat. Thereby, the power units 59 keep the base parts 54 in their positions, and the lever parts 52 pivot around the articulation shafts 53 downwards so that gaps are formed between both the upper edges and the lower edges of the lever parts 52 and the base parts 54. In such a situation the centers of the intermediate rolls 5 are in a horizontal plane substantially at the level of the articulation shafts 53.

Since the base parts 54 move along with the intermediate rolls 5 both in connection with the raising and in connection with the opening of the system of rolls 2, the change in the angles of the lever parts 52 in relation to the base parts 54 is quite little. Moreover, this change in the angle is substantially equally large in the case of all intermediate rolls 5, so that the intermediate rolls 5 remain in line with each other. In supercalenders, commonly an abundance of steam is used, which is supplied through steam-moistening pipes into nips or into pockets formed by the paper web, rolls, and the takeoff. However, steaming has the drawback that it promotes gathering of dirt in the constructions of a calender, e.g. the guides 7. This might result, e.g., in jamming of the base parts 54 in the guides 7. Since, in the solution in accordance with the invention, the base part 54 moves constantly along with the roll 5 when the system of rolls 2 is being opened and regulated, such jamming cannot occur.

As was already ascertained once above, attenuation devices 10 are arranged to be effective between the lever parts 52 and the base parts 54 of the intermediate rolls 5, these attenuation devices 10 supporting the bearing housing 51 in relation to the base part 54. In the embodiment shown in FIGS. 1 to 3, the attenuation device comprises a preferably hydraulic or pneumatic cylinder-piston device, which, by the effect of the pressure medium, produces a force that pivots the bearing housing 51 relative to the articulation shaft 53, by means of which force the loads arising from the bearing housing 51 and from a takeoff roll possibly attached to same are relieved, which forces would, in the contrary case, attempt to deflect the profile of the roll 5, because the loading of the roll 5 would be higher in the lateral areas of the roll than in the middle part. The journal loads arising from the base parts 54 on the rolls are additionally relieved by means of a power unit 59, by whose means the base part 54 is raised in relation to the spindle nut 56. In addition to the relieving of the journal loads, the attenuation device 10 attenuates and equalizes the forces and oscillations arising from the movements of the nips $N_1 \ldots N_4$ efficiently.

Figure 4:
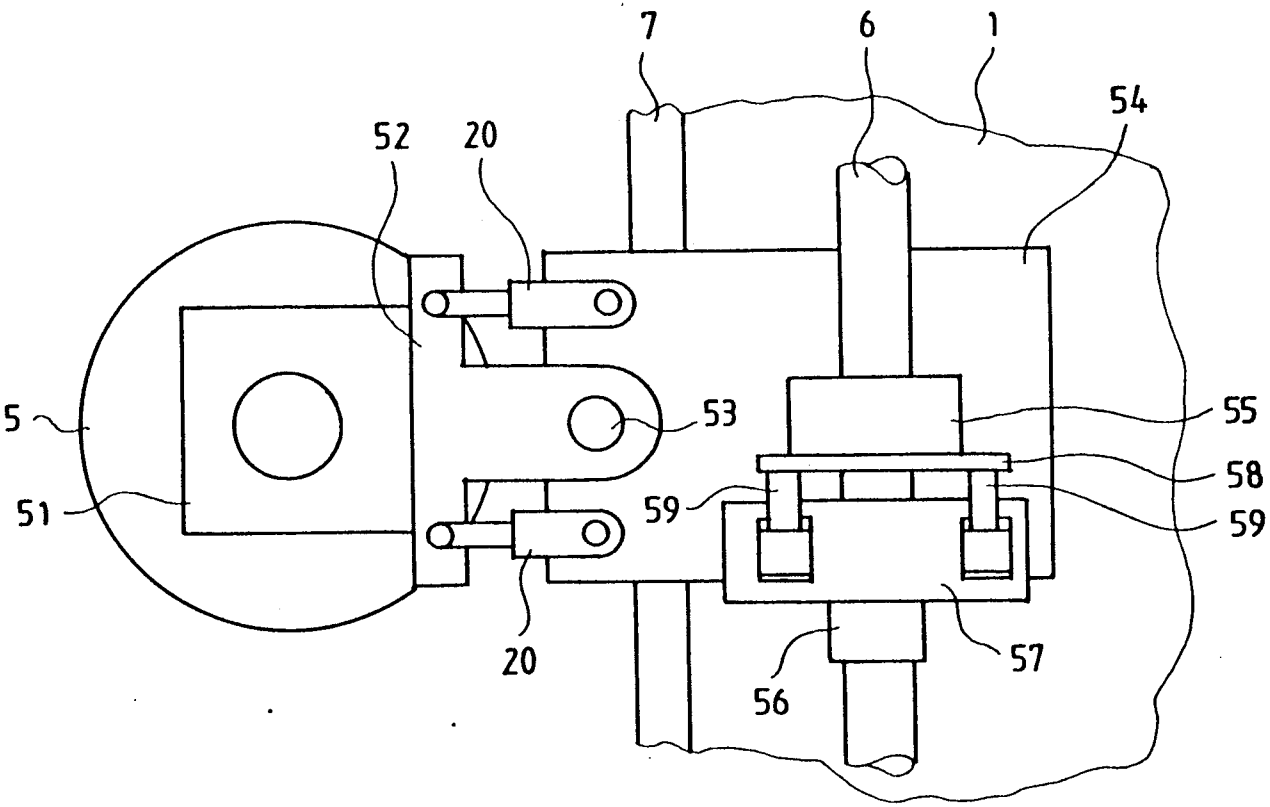
FIGS. 4 to 6 show embodiments alternative to the solution shown in FIG. 3.

FIG. 4 shows an embodiment alternative to the solution shown in FIG. 3. In the solution shown in FIG. 4, double attenuation devices 20 are fitted between the lever part 52 and the base part 54 of the intermediate roll 5 at opposite sides of the articulation shaft 53, these devices 20, thus, acting upon the bearing housing 51 so as to pivot it in opposite directions relative to the articulation shaft 53. The solution shown in FIG. 4 is highly advantageous, because by means of the attenuation member placed below the articulation shaft 53, a relieving of the journal loads is obtained that is similar to that described above in relation to FIG. 3. In the solution shown in FIG. 4, the attenuation member 20 placed above the articulation shaft 53 operates as a highly efficient attenuator of oscillation, which equalizes the forces arising from movement of the nip and attenuates oscillations.

Figure 5:
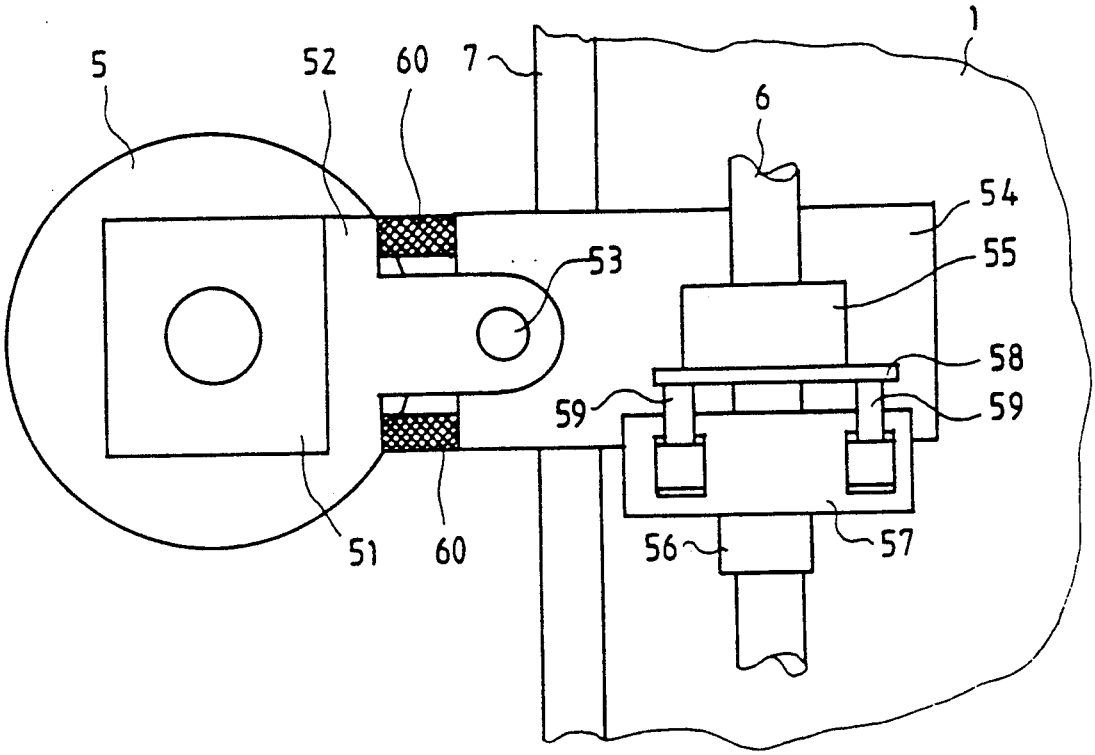

In the embodiment shown in FIG. 5, the cylinder-piston devices 10, 20 shown in FIGS. 3 and 4 have been substituted for by attenuation members 60 fitted between the lever part 52 and the base part 54, which are preferably made of an elastic material. Thus, the solution shown in FIG. 5 is simpler and has a lower cost of manufacture as compared with the embodiments shown in FIGS. 3 and 4. In the embodiment shown in FIG. 5, in respect of their material and physical properties, the attenuation devices 60 have been manufactured so that, when the base part 54 has been placed at the correct level in relation to the spindle nut 56 by means of the power units 59, the lower attenuation member 60 in FIG. 5, when compressed, produces a sufficiently high force by means of which the journal loads on the roll 5 are relieved. In the solution shown in the figure, the upper attenuation member 60 operates exclusively as an attenuator of oscillations.

It is possible to depart from the embodiment of FIG. 5 so that the upper attenuation member 60 is omitted completely. This procedure is possible particularly when no large external forces are supported on the bearing housing 51, but the bearing housing 51 carries the roll 5 only. Moreover, it is possible to combine the embodiments shown in FIGS. 3, 4, and 5, for example, so that the attenuation device below the articulation shaft 53 is, e.g., a cylinder-piston device 10 shown in FIG. 3, whereas the upper attenuation device is an attenuation member 60 shown in FIG. 5 this member being, in such a case, functional to attenuate oscillations.

Figure 6:
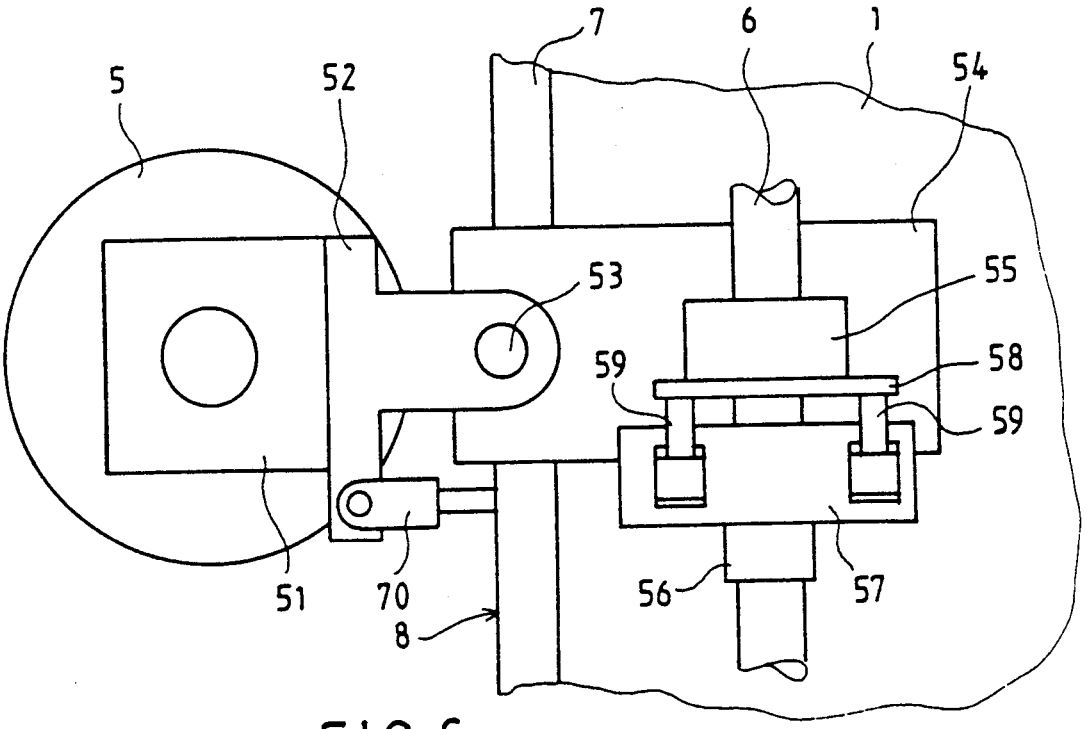

FIG. 6 shows a further embodiment, which differs from those described above in the respect that in this embodiment the attenuation device 70 is supported on the lever part 52 at one end, and on the front face 8 of the guide 7 at the opposite end. In respect of its operation and construction, the attenuation device 70 may be, e.g., a cylinder-piston device corresponding to the attenuation device 10 shown in FIG. 3. In the embodiment shown in FIG. 6, it is also possible to install an attenuation member similar to that shown in FIG. 5 above the articulation shaft 53 between the lever part 52 and the base part 54.

To summarize the above, the following can be stated. By means of the relief devices 57 fitted between the base parts 54 of the intermediate rolls 5 and the spindle nuts 56, relieving of the journal loads applied to the intermediate rolls can be carried out efficiently and, moreover, by means of said relief devices 57, an instantaneous opening of the system of rolls 2 is carried out in the way described above. The loads arising from the bearing housings 51 and from additional loads that may be supported on them, such as takeoff rolls, are relieved in the solution in accordance with the invention by means of attenuation devices 10, 20, 60 fitted between the base part 54 and the lever part 52. This relieving can also be arranged so that the attenuation device 70 is arranged between the lever part 52 and the calender frame 1.

During operation, i.e. when the system of rolls 2 is in the closed position, the base parts 54 of the intermediate rolls 5 are kept in their positions in relation to the spindle nuts 56 by means of relief devices 57. On the contrary, during raising and lowering of the system of rolls 2, the base parts 54 move along with the rolls 5. Raising of the system of rolls 2 for the purpose of regulation of the system of rolls can be arranged, with the solution in accordance with the invention, by means of a lower roll 4 of the floating type, and instantaneous opening of the system of rolls 2 is carried out by means of the relief device 57, as was stated above.

Above, the invention has been described by way of example with reference to the figures in the accompanying drawing. This is, however, not supposed to restrict the invention to the exemplifying embodiments illustrated in the figures along, but many variations are possible within the scope of the inventive idea defined in the accompanying patent claims.

What is claimed is:

1. A calender comprising:

a frame;

a stack of rolls mounted on said frame, said stack of rolls comprising an upper roll, a lower roll and a plurality of intermediate rolls placed between said upper roll and said lower roll;

a plurality of base parts, each of said base parts being connected to an individual roll and being vertically displaceable along guides provided in said frame;

a plurality of lifting spindles and a plurality of spindle nuts respectively placed on each lifting spindle, said lifting spindles and spindle nuts functioning to vertically position those of said plurality of base parts connected to an intermediate roll;

a plurality of pressure-medium operated relief devices, each device connected between a base part and a spindle nut and functioning to reduce journal loads on said plurality of intermediate rolls;

said plurality of intermediate rolls each having a bearing housing respectively attached to one of said base parts;

a plurality of articulation shafts each parallel to a longitudinal axis of an intermediate roll and to each of which one of said plurality of base parts is pivotable;

a plurality of attenuation devices for respectively supporting said plurality of articulation shafts so as to equalize forces resulting from movement of nips between said rolls and to attenuate oscillation of said rolls;

further comprising a plurality of lever parts, said lever parts connecting said bearing housings of said intermediate rolls to said base parts and said attenuation devices are fitted between said lever parts and said base parts to limit pivoting of said lever parts in relation to said base parts;

whereby each said bearing housing is lifted by a force acting between a respective base part and a respective said lever part.

2. The calender of claim 1 wherein said articulation shafts are respectively supported on said base parts.

3. The calender of claim 1 wherein said articulation shafts are attached to said frame.

4. The calender of claim 1 wherein said pressure medium relief devices comprise vertically acting power units which support said base parts during calender operation and by means of which the intermediate rolls can be lowered for opening of said stack of rolls, and that said attenuation devices comprise means for producing a force to compensate for forces arising from said bearing housings of said intermediate rolls.

5. The calender of claim 1, wherein said attenuation devices respectively support said bearing housings in closed system operation and during raising of said stack of rolls.

6. The calender of claim 1, wherein said lower roll is a variable-crown roll and comprises a revolving roll mantel over its entire axial length, a roll axle, and a plurality of hydraulic members, said roll mantle being supported by said hydraulic members on said roll axle in the direction of the nip plane.

7. The calender of claim 5 wherein, when said stack of rolls is in an opened position, said lever parts of said intermediate rolls are in positions pivoted downward around said articulation shafts at a slight turning angle relative to said base parts which is substantially equal for all of said intermediate rolls.

8. The calender of claim 5 wherein, when said stock of rolls has been raised for the purpose of regulation of said lifting spindles, said lever parts of said intermediate rolls are in a position pivoted upwards around said articulation shafts at a slight turning angle relative to said base parts which is substantially equal for all of said intermediate rolls.

9. The calender of claim 2, wherein said vertically acting power units are cylinder-piston devices.

10. The calender of claim 1, wherein said attenuation devices comprise attenuation members which are made of an elastic material.

* * * * *